343-872
8/3/82 XR 4,343,000 SR

United States Patent [19]
Macidull

[11] 4,343,000
[45] Aug. 3, 1982

[54] AIRCRAFT SELF-PROTECTION RADAR

[75] Inventor: John C. Macidull, Arlington, Va.

[73] Assignee: The United States of America as represented by the Secretary of the Navy, Washington, D.C.

[21] Appl. No.: 251,617

[22] Filed: Apr. 6, 1981

[51] Int. Cl.[3] ..... H01Q 1/28
[52] U.S. Cl. ..... 343/705; 343/872
[58] Field of Search ..... 343/872, 705–708

[56] References Cited

U.S. PATENT DOCUMENTS 3,063,654 11/1962 Youngren et al. ..... 343/872
3,798,655 3/1974 Meek et al. ..... 343/754
3,820,116 6/1974 Carlsson et al. ..... 343/756
3,821,746 6/1974 Mizusawa et al. ..... 343/781
3,914,768 10/1975 Ohm ..... 343/779
4,034,378 5/1977 Ohm ..... 343/781
4,148,040 4/1979 Lunden et al. ..... 343/708
4,198,639 4/1980 Killion ..... 343/872

*Primary Examiner*—David K. Moore
*Attorney, Agent, or Firm*—Robert F. Beers; W. Thom Skeer; Roger F. Phillips

[57] ABSTRACT

Reflector means is placed in the path of the energy beam of a radar to intercept a peripheral portion of the beam and divert sufficient radar waves to cover a portion of the field-of-view in the opposite direction.

6 Claims, 3 Drawing Figures

AIRCRAFT SELF-PROTECTION RADAR

BACKGROUND OF THE INVENTION

1. Field of the Invention

This invention relates to an aircraft self-protection warning system and particularly to such a system utilizing radar. Yet more particularly, the invention relates to a warning system having the ability to simultaneously maintain surveillance both fore and aft with a single radar.

2. Description of the Prior Art

Conventional radar systems for aircraft warning protection have either depended upon a forward-looking radar only or have had separate radar units for rear or side coverage. The forward-looking systems have been housed in the forward nosecone with little or no external portions to cause aerodynamic drag. Side and rear installations, however, almost invariably have required structures outside of the normal aerodynamic surfaces of the aircraft. Because such installations require modifications of the airframe, the provision of such additional protection has been resisted.

It is an object of this invention to provide a radar unit having a pattern of waves radiating in one direction and a portion of such pattern intercepted by means reflecting a portion of said waves in the opposite direction.

It is a further object of the present invention to provide fore and aft protection in a single radar unit confined within the conventional nosecone radome of an aircraft.

SUMMARY OF THE INVENTION

In accordance with the present invention, reflector means is placed in the nosecone radome structure in a position to intercept a portion of the outer periphery of the waveform of the radar and reflect a portion of the waves in a rearward direction. The rearwardly reflected waves form a hollow cone or rectangle, for example, to detect objects to the rear of the aircraft.

Although this aft-looking beam has some central blind area, this area can be covered by the pilot simply by moving the aircraft such that the ring of wave energy sweeps through the blind spot.

DESCRIPTION OF THE PREFERRED EMBODIMENT

Figure 1:
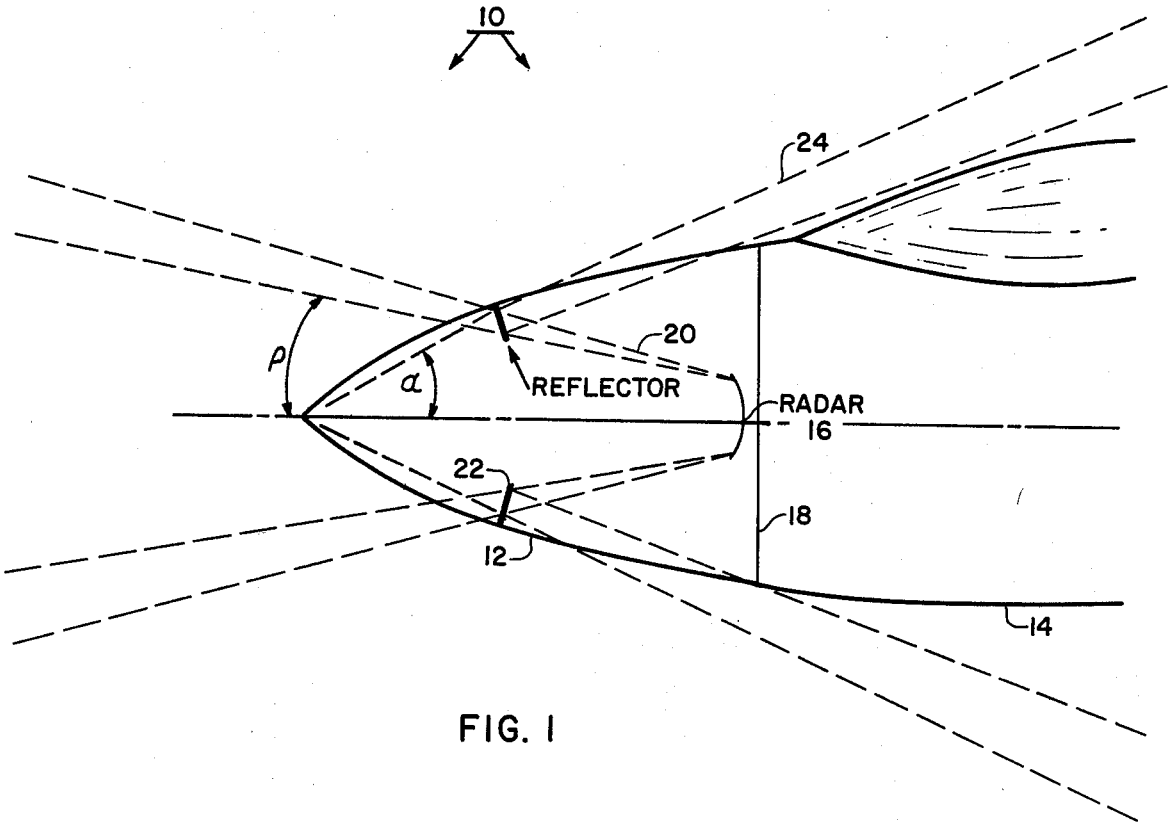
FIG. 1 is a diagrammatic cross-sectional view of a typical aircraft with a radar installed in the nosecone according to the present invention.

A radar system according to the invention is schematically illustrated on the drawing installed in an aircraft generally indicated by the numeral 10. The aircraft 10 has a typical nosecone 12 attached to the fuselage 14.

In nosecone 12 a radar system generally indicated at 16 is attached to the firewall 18 and emits energy rays represented by dotted lines 20. The forward looking radar is limited to an angular cone $\rho$.

A reflector 22 is placed inside of cone 12 in a manner to intercept a peripheral portion of the wave energy indicated at 20. The reflector 22 has a surface sufficient to efficiently reflect the intercepted portions of the waves 20 toward the rear of the aircraft in an energy beam indicated at 24. The beam has an exterior limit shown by angle $\rho$. The beam has an interior limit which is determined by the limits on cone 12 avoiding aircraft 10.

The energy beam 24, of course, cannot cover the area of blindness directly to the rear of the aircraft, but with normal maneuvering, an attack aircraft would probably be required to transit the area of coverage to arrive in the blind area. Also, maneuvering changes in pitch or yaw would cause the energy beam to sweep the blind area. In the case of aircraft flying in formation, little or no area to the rear would be left without coverage because of the overlapping of the several energy beams.

Figure 2:
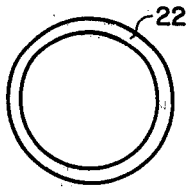
FIG. 2 is a plane view of the reflector unit in FIG. 1.

Forward-looking radar devices have different angles of view. Different shapes of aft-looking reflectors can be retrofitted to compensate for each type. The circular disc-shaped reflector 22 shown in FIGS. 1 and 2 would be useful mainly with forward-looking radar with a circular field-of-view.

Figure 3:
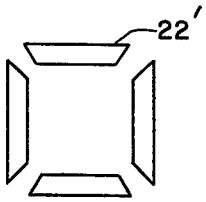
FIG. 3 is a plane view of a modification of the reflector shown in FIG. 1.

Some modern radar units have a rectangular field-of-view. In this case, rectangular reflectors or discrete reflector elements in polylateral array would be used. See FIG. 3. It is sufficient that, in any case, the peripheral reflectors intercept only a small portion of the peripheral edge of the radar beams (i.e. the difference between angles $\rho$ and $\alpha$ should be relatively small). The reflectors may be flat or have a curved (e.g. parabolic) surface. Also, because some aircraft radar can be physically slewed to change viewing direction, these reflectors could be mounted on the moving portion of the radar itself instead of on the inside of the nosecone. Reflector surfaces may be continuous or discontinuous and may conform to the general outline of geometrical patterns.

From the foregoing it may be seen that this invention provides the pilot with a low-cost, aft-looking component to complement the forward-looking radar beam to display aircraft and missiles in the immediate vicinity in time to allow evasive action. It is obvious to those skilled in the art that numerous modifications can be made.

What is claimed is:

1. A combination forward and aft-looking airborne radar antenna apparatus comprising a forward aerodynamic housing;

a forward-looking aircraft antenna in said housing for producing a forwardly projecting pattern of energy waves;

reflecting means in said housing arranged to intercept a peripheral portion of said energy wave and reflect said waves in a rearward direction.

2. The apparatus of claim 1 wherein said reflecting means is attached to the inner wall of said housing.

3. The apparatus of claim 1 wherein said reflecting means is attached to a portion of the radar antenna apparatus.

4. The apparatus of claim 2 or 3 wherein said reflecting means is curved.

5. The apparatus of claim 2 or 3 wherein said reflecting means is polylateral.

6. The apparatus of claim 2 or 3 wherein said reflecting means comprises discrete reflecting surfaces arranged in a geometric pattern.

* * * * *